US005382940A

United States Patent [19]

Takemoto et al.

[11] Patent Number: 5,382,940

[45] Date of Patent: Jan. 17, 1995

[54] ALARM SYSTEM FOR AMUSEMENT ARCADE

[75] Inventors: Takatoshi Takemoto; Koji Yanagisawa, both of Tokyo, Japan

[73] Assignee: Kabushiki Kaisha Ace Denken, Tokyo, Japan

[21] Appl. No.: 30,979

[22] Filed: Mar. 12, 1993

[30] Foreign Application Priority Data

Mar. 25, 1992 [JP] Japan ..... 4-015642[U]

[51] Int. Cl.[6] ..... G08B 23/00

[52] U.S. Cl. ..... 340/323 R; 364/410

[58] Field of Search ..... 340/323 R, 525; 364/410; 273/138

[56] References Cited

U.S. PATENT DOCUMENTS 4,072,930 2/1978 Lucero et al. ..... 273/138

4,534,373 8/1985 Glinka et al. ..... 453/29

*Primary Examiner*—John K. Peng

*Assistant Examiner*—Daryl C. Pope

*Attorney, Agent, or Firm*—Lowe, Price, LeBlanc & Becker

[57] ABSTRACT

An alarm system, for warning of the occurrence of an event at a certain island in an amusement arcade where plural islands of game machines are installed, comprises: plural indicators for each island, each for indicating the occurrence of an event, which needs to be notified to the arcade attendant; plural event detectors for each island, each for detecting the occurrence of an event, which needs to be notified to the arcade attendant and for activating the corresponding indicator upon detection of such an event; and the indicators being disposed at both upper ends and an upper central portion of every row of game machines in each island.

16 Claims, 11 Drawing Sheets

FIG. 11
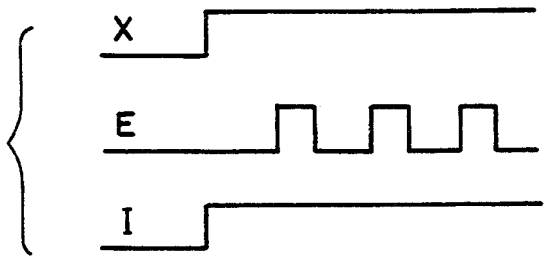
FIG. 12
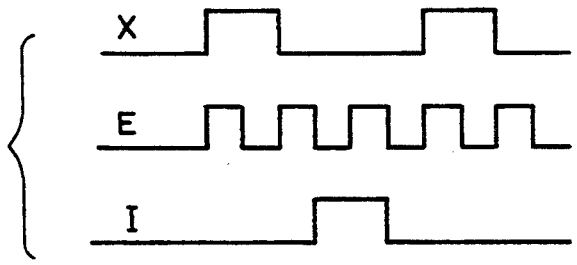
FIG. 13
| | X | E | I |
|---|---|---|---|
| EVENT | CALL PRIZE | ——— | PRIZE |
| ACTION OF INDICATOR | LIGHTING | LIGHTING | FLASHING |
| | | | |
|---|---|---|---|
| EVENT | FOULPLAY CALL PRIZE | ——— | CALL |
| ACTION OF INDICATOR | FLASHING | FLASHING | FLASHING |
| | | | |
|---|---|---|---|
| EVENT | FOULPLAY PRIZE CALL | | NO EVENT |
| ACTION OF INDICATOR | FLASHING | FLASHING | TURNED OFF |

FIG. 14

| | X, Y | E |
|---|---|---|
| EVENT | CALL PRIZE | —— |
| ACTION OF INDICATOR | LIGHTING | LIGHTING |

| | | |
|---|---|---|
| EVENT | FOULPLAY CALL PRIZE | —— |
| ACTION OF INDICATOR | FLASHING | FLASHING |

| | | |
|---|---|---|
| EVENT | FOULPLAY PRIZE CALL | —— |
| ACTION OF INDICATOR | FLASHING | FLASHING |

ALARM SYSTEM FOR AMUSEMENT ARCADE

BACKGROUND OF THE INVENTION

1. Field of the Invention

This invention relates to an alarm system for warning of the occurrence of an event at an island of game machines in an amusement arcade.

2. Description of the Related Art

Generally in an amusement arcade where many game machines such as pachinko game machines and slot machines are installed in units of islands, each island includes one or two rows of the same kind of game machines. These game machine islands are arranged parallel to one another.

In an amusement arcade, an abnormality may occur with an individual game machine, and such an abnormal condition should be remedied as soon as possible. To supervise the occurrence of an abnormal condition and to repair the abnormal condition, a plurality of arcade attendants are alerted, usually one for each island. Consequently it would be difficult for each attendants to watch individual game machines within the island.

To this end, it has been a common practice to provide indicator lamps at both ends of every game machine island for warning of the occurrence of an abnormal condition or event within the island. In this event, for example, arcade attendants can realize the occurrence of the abnormal condition when an alarm switch is depressed by a player, or in response to the activation of a sensor mounted in an individual game machine.

However, since the conventional indicator lamps are located only at both ends of each game machine island, it would take rather a long time for the attendants to notice the occurrence of an abnormality when patrolling along the path between adjacent parallel islands, during which time the indicator lamps are beyond the attendant's field of vision.

Further since the conventional indicator lamps merely light or flash when activated, the keeper can obtain no information other than that an abnormality has occurred.

SUMMARY OF THE INVENTION

It is therefore a first object of this invention to provide an alarm system, for an amusement arcade, in which even when patrolling along the path between adjacent parallel islands, an arcade attendant can discern the occurrence of an event which needs to be settled, easily, reliably and without delay.

A second object of the invention is to provide an alarm system, for an amusement arcade, in which an arcade attendant can grasp the general content of an alarm from indication of the occurrence of an abnormal condition and so effect a quick repair.

According to a first aspect of the invention, there is provided an alarm system for warning of the occurrence of an event at a certain island in an amusement arcade where a plurality of islands of game machines are installed, each island having one or two rows of game machines, the alarm system comprising: a plurality of indicators for each island, each for indicating the occurrence of an event, which needs to be notified to the arcade attendant; a plurality of event detectors for each island, each for detecting the occurrence of an event, which needs to be notified to the arcade attendant, for each island, and for activating the corresponding indicator upon detection of such an event; and the indicators being disposed at both upper ends and an upper central portion of every row of the game machines in each island.

According to a second aspect of the invention, there is provided an alarm system comprising indicators and event detectors, each of the event detectors including: one or more input devices; a discriminator for discriminating the content of an event for the signal which is received through the input devices and indicating the occurrence of the event; and an indicator control unit for determining an indicating mode of the lamp based on the result of the discrimination, the indicator control unit having a function of determining the indicating mode of the lamp out of a plurality of indicating modes, which include a continuous lighting mode, a flash lighting mode and a non-lighting mode, corresponding to a plurality of predetermined events to be indicated.

In operation, the event detector of each island detects the occurrence of an event, which needs to be notified to the arcade attendant, and activates the indicators of the island. The occurrence of an event is detected through an input device such as a manual switch which inputs a signal to the system when depressed by a player.

When an event which needs to be notified to the arcade attendant occurs in an island, the indicators of the island indicate the occurrence of the event in response to the detection by the event detector. The indicators are arranged at both upper ends and an upper central portion of every game machine row of the island. With this arrangement of the indicators, at least one of the indicators can easily come into the arcade attendant's field of vision, either when the attendant is near one end of the island or in the path between adjacent parallel islands. The attendant can therefore discern the occurrence of an event such as an abnormal condition without delay.

In the event detector, upon receipt of a signal taken from the input device and indicating the occurrence of an event, the discriminator discriminates the content of the event. The indicator control unit determines the indicating mode of the indicator lamp based on the result of the discrimination for every indicator lamp. The indicating mode is determined in combination of a continuous lighting mode, a flash lighting mode and a non-lighting mode. This indicating mode combination should be predetermined according to an event to be indicated.

From the indicating mode of the indicator, the arcade attendant can find the content of an event simultaneously with the occurrence of the event.

BRIEF DESCRIPTION OF THE DRAWINGS

FIG. 11 is a waveform diagram illustrating how the individual indicating elements act;

FIG. 12 is a waveform diagram illustrating how the individual indicating elements act;

FIG. 13 is a diagram illustrating how the individual indicating elements act;

FIG. 14 is a diagram illustrating how the individual indicating elements act.

DETAILED DESCRIPTION

One embodiment of this invention will now be described with reference to the accompanying drawings.

Figure 1:
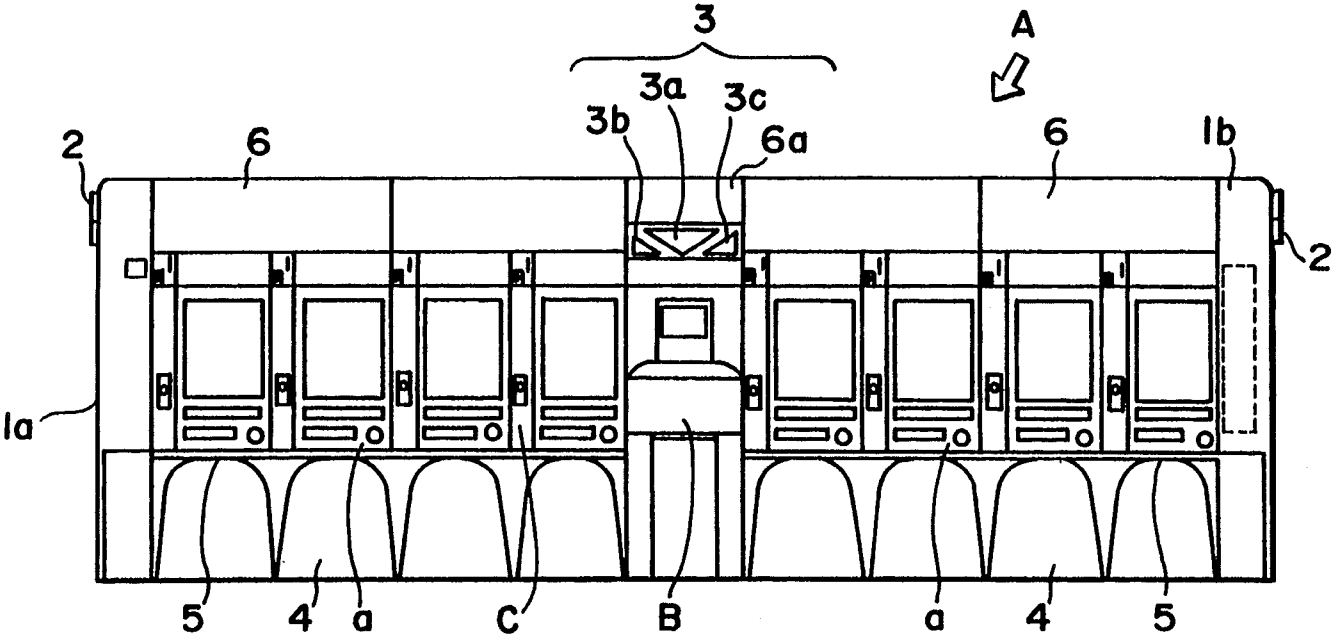
FIG. 1 is a front view of a game machine island in which an alarm system for an amusement arcade is incorporated according to one embodiment of this invention.
Figure 2:
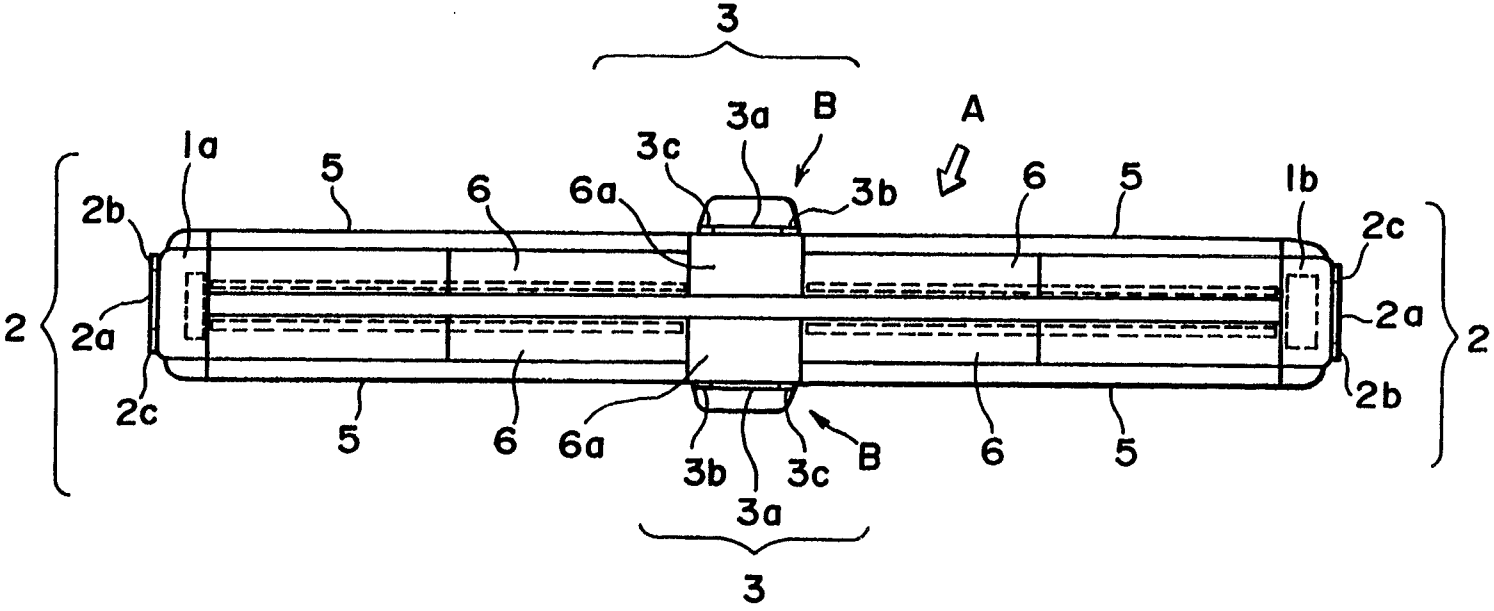
FIG. 2 is a plan view of the game machine island.
Figure 4:
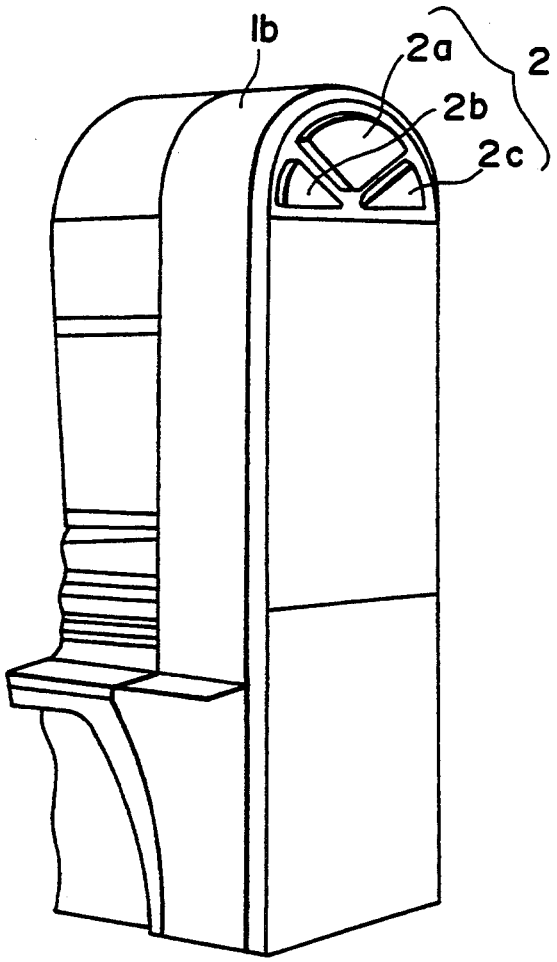
FIG. 4 is a perspective right side view of the game machine island.
Figure 5:
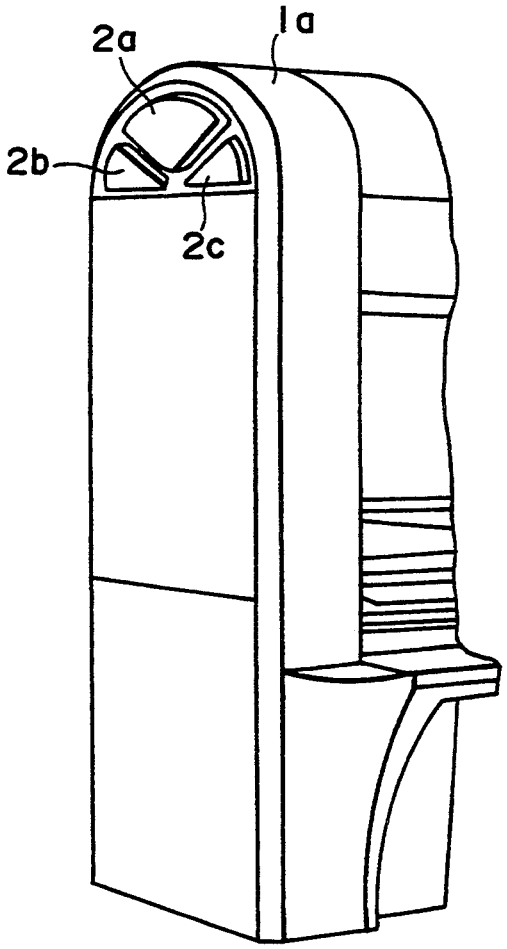
FIG. 5 is a perspective left side view of the game machine island.

FIG. 1 is a front view of a game machine island in which an alarm system for an amusement arcade is incorporated according to this embodiment; and FIGS. 2, 4 and 5 are a plan view, a right side view and a left side view, respectively, of FIG. 1.

The game machine island A of this embodiment includes two parallel rows of game machines, as shown in FIG. 2, but may include only a single row of game machines. The island A includes on both the front and rear sides a plurality of game machines a, two token counters B, and a plurality of token dispensers C; the game machines a and the token dispensers C are arranged alternately, and the two counters B are disposed one at a central portion of each of the front and rear rows.

Specifically, a pair of parallel rows of support plates 4 (FIG. 1) are arranged for supporting a pair of horizontal shelf plates 5 along which the game machines a and the token dispensers C are arranged. The upper portions of the game machines a and the token dispensers C are covered by a pair of rows of curtain plates 6, and both ends of the game machine islands A are covered respectively by a pair of ornamental covers 1*a*, 1*b*. The counter B is desposed separately. The upper portion of each counter B is covered by a separate curtain plate 6*a*.

The game machines a may be, for example, pachinko game machines and slot machines. In pachinko game machines, metal balls (called "pachinko balls") are used as tokens. Whereas in slot machines, medals are used as tokens.

Though illustration is omitted in FIG. 1, an independent indicator 80 (FIG. 15) is disposed upwardly of each game machine a. The independent indicator 80 is composed of light-emitting devices such as light-emitting diodes or electric bulbs. The independent indicator 80 identifies a game machine in which an event has occurred. Each game machine a is provided with a switch 71 (FIG. 15) for notifying the arcade attendant of the occurrence of an abnormal condition.

The token dispenser C dispenses tokens whose kind depends on the kind of game machines arranged in the islands. For instance, in the case of pachinko game machines, the token dispenser C dispenses pachinko balls. Upon insertion of a coin, paper currency or a prepaid card, the token dispenser C takes the necessary value and dispenses a number of tokens corresponding to the value taken. The tokens may be for sale or rent. In the illustrated embodiment, they may be for rent.

Figure 15:
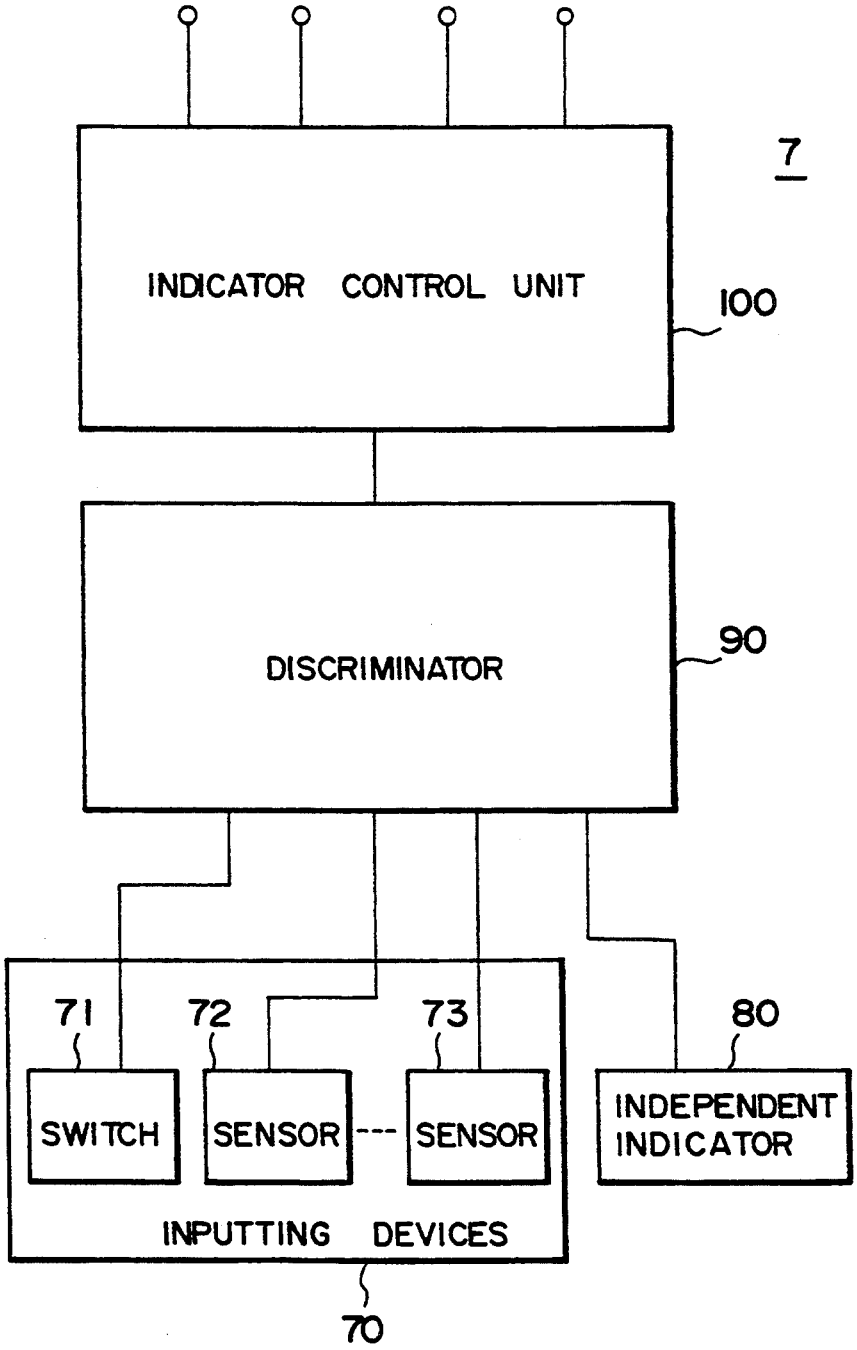
FIG. 15 is a block diagram showing an event detector to be used in the embodiment.

The token dispenser C, like the game machine a, may also be provided with an independent indicator 80 and a switch 71, as shown in FIG. 15.

The counter B counts the tokens the player gains from the game machine and collects them in the game machine island for reuse.

An indicator 2 is mounted on each of the ornamental covers 1*a*, 1*b* located at both ends of the game machine island A. The indicator 2 is disposed at the uppermost portion of the outer surface of each ornamental cover 1*a*, 1*b* and has an indication surface bulging outwardly beyond the outer surface of each ornamental cover 1*a*, 1*b*. The indicator 2, as shown in FIGS. 4 and 5, is composed of a plurality of indicating elements 2*a*, 2*b*, 2*c*. The indicating elements 2*a*, 2*b*, 2*c* are indicating lamps, such as electric bulbs, light-emitting diodes or light-emitting devices in the form of liquid crystal indicating elements with a back lamp. In this embodiment, the indicating elements 2*a*, 2*b*, 2*c* are three indicating lamps, but this invention should by no means be limited to this specific example. The reason why the indicating elements 2*a*, 2*b*, 2*c* are used is to define the content of indication by a combination of selected lamps. Further, in this embodiment, each indicating element 2*a*, 2*b*, 2*c* has a fan shape; but it may have any other shape. Furthermore the indicating elements 2*a*, 2*b*, 2*c* may be colored differently.

Figure 3:
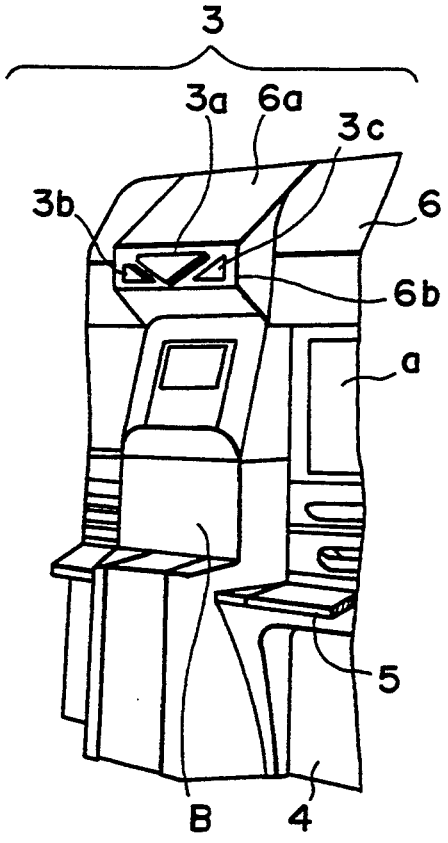
FIG. 3 is a perspective view of a central portion of the game machine island, showing the appearance of a token counter.

The curtain plate 6*a* covering the upper portion of each counter B, as shown in FIGS. 1 through 3, is provided with an indicator 3. The indicator 3 has an indication surface bulging beyond the front surface 6*b* of the curtain cover 6*a* and, as shown in FIGS. 1 and 3, includes a plurality of indicating elements 3*a*, 3*b*, 3*c* which are indicating lamps, such as electric bulbs, light-emitting diodes or light-emitting devices in the form of liquid crystal indicating elements with a back lamp. In this embodiment, the indicating elements 3*a*, 3*b*, 3*c*, like the indicating elements 2*a*, 2*b*, 2*c*, are three indicating lamps, but this invention should by no means be limited to this specific example. For the same reason as mentioned in connection with the indicating elements 2*a*, 2*b*, 2*c*, the indicating elements 3*a*, 3*b*, 3*c* are used. Further each indicating element 3*a*, 3*b*, 3*c* has a triangular shape, but may have any other shape. Furthermore the indicating elements 3*a*, 3*b*, 3*c* may be colored differently.

In this embodiment, the indicating elements 3*a*, 3*b*, 3*c* are located at the same level as the indicating elements 2*a*, 2*b*, 2*c* so that the arcade attendant can take a look at the indicator 3 without turning his/her gaze upwardly or downwardly and thus without becoming fatigued.

Figure 6:
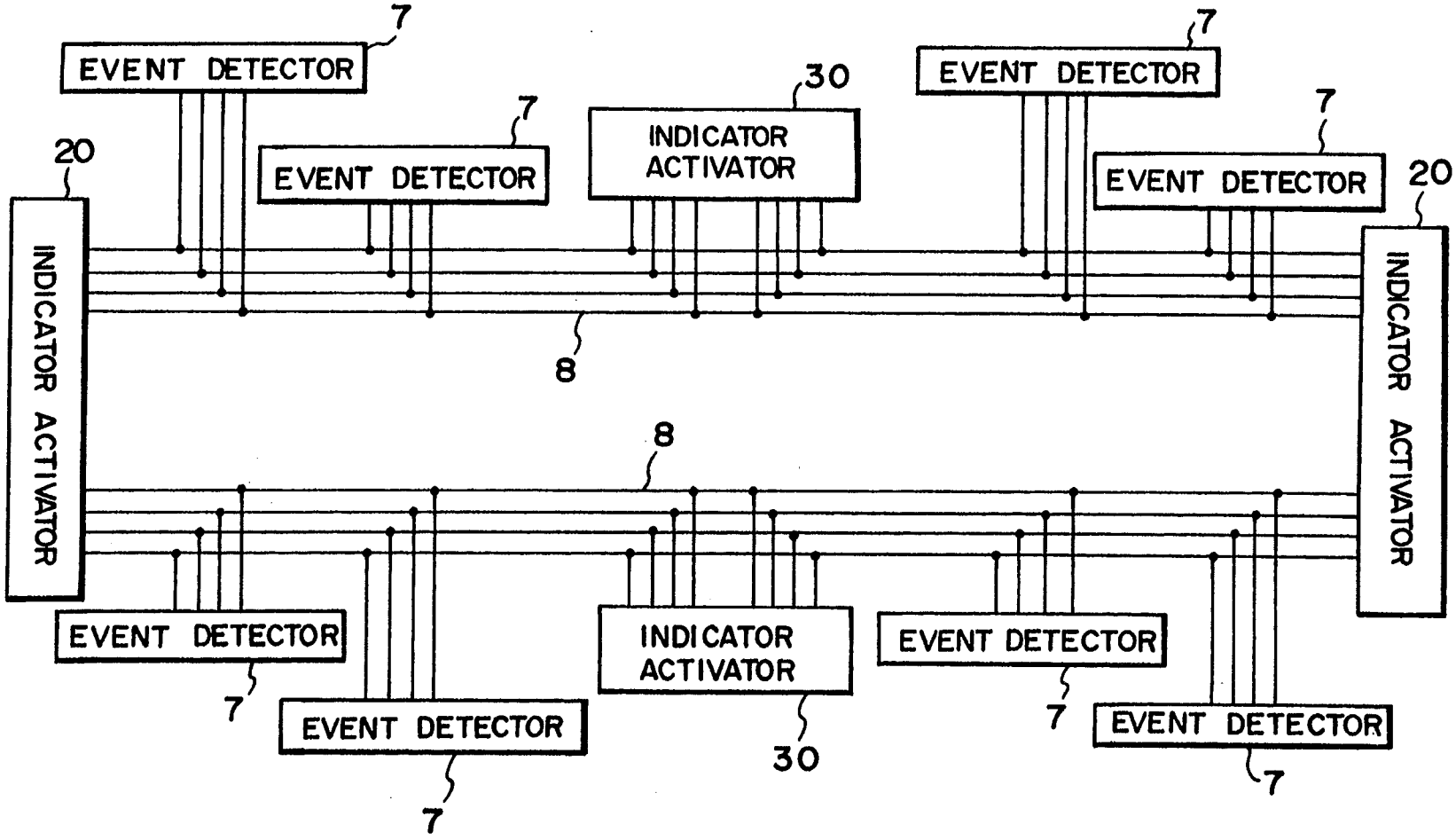
FIG. 6 is a wiring diagram showing the general construction of the alarm system in this embodiment.

The alarm system of this embodiment, as shown in FIG. 6, generally comprises first indicator activators 20 for activating the indicators 2 at both ends of the game machine island, a second indicator activator 30 for activating the indicator 3 at one side of the island and a plurality of event detectors 7, which are connected in parallel to one another via signal lines 8. Likewise the first indicator activators 20 at both ends, the second indicator activator 30 at the other side of the island and a plurality of event detectors 7 are connected in parallel to one another via signal lines 8. The event detectors 7 are associated with the individual game machines a and the token dispensers C. When any of the event detectors 7 detects a cause that turns the indicators 2, 3 on, control signals will be sent to the first indicator activators 20 and the second indicator activator 30 via signal lines 8, to turn on the indicators 2, 3 in the game machine row in which the cause occurs. Alternatively both the second indicators 3 at opposite sides may be turned on.

As illustrated in FIG. 12, the event detector 7 includes a group of input devices 70 for inputting, to the alarm system, the occurrences of events in the individual game machines a and token dispenser C, an independent indicator 80 for notifying the occurrence of individual events in the game machines and token dispensers C, a discriminator 90 for discriminating the content of the event inputted, and an indicator control unit 100 for controlling the indicators 2, 3 according to the result of discrimination.

The group of input devices 70 includes switches 71 each to be operated by a player, and a group of sensors 72, 73.

The switch 71 may be a call switch which is a push-button type.

The sensor 72 may be a prize detecting sensor. Ordinarily in this type of game machine, when a token enters a particular hole of the game machine, a predetermined number of tokens will be dispensed to the player from the game machine. "Prize" means to dispense bonus tokens as a prize to the player if the game machine assumes a status satisfying a predetermined condition. A sensor for detecting this prize detects that a token has reached a predetermined position, and such a sensor may be, for example, an approach relay such as a contact relay or a photo relay. In the case where the game machine takes a predetermined action on attaining a prize, a sensor may detect a signal indicating a voltage change needed for the action. Alternatively a sensor may detect the prize status itself. These sensors may be arranged individually or in parallel.

The sensor 73 may be a sensor for foulplay detection. The sensor 73 is exemplified by a magnetic sensor for detecting the approach of a magnet, a high voltage detector for detecting, for example, the impressing of a high voltage and a limit switch for detecting the opening of a door.

Figure 7:
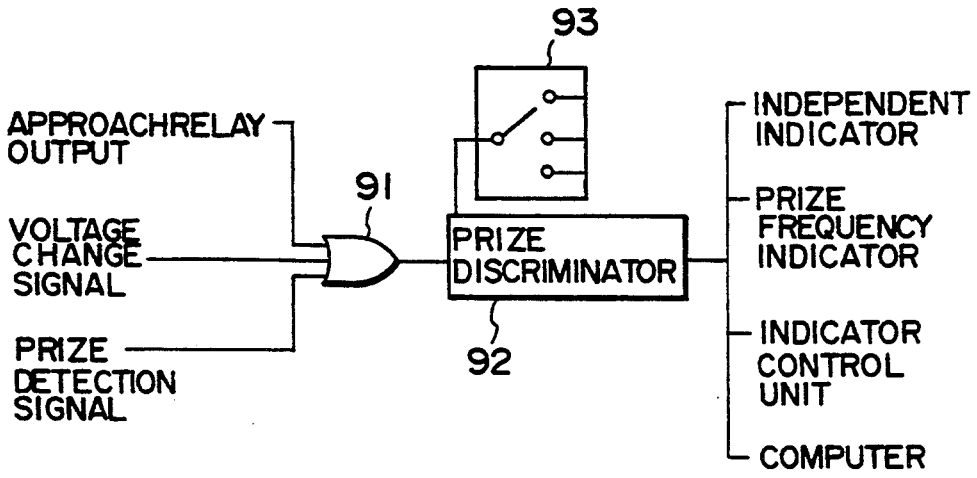
FIG. 7 illustrates a prize discriminating function in the embodiment.

For the prize discriminating function, the discriminator 90, as shown in FIG. 7, includes an OR circuit 91 for taking the logical sum of various inputs, a prize discriminating circuit 92 for discriminating whether or not the input signal, with respect to the logical sum output of the OR circuit 91, continues for a predetermined duration, and a prize discrimination selecting switch 93 for setting a duration. In FIG. 7, an approach relay output signal, a voltage change signal and a prize detection signal are shown, as examples of the various input signals.

Figure 8:
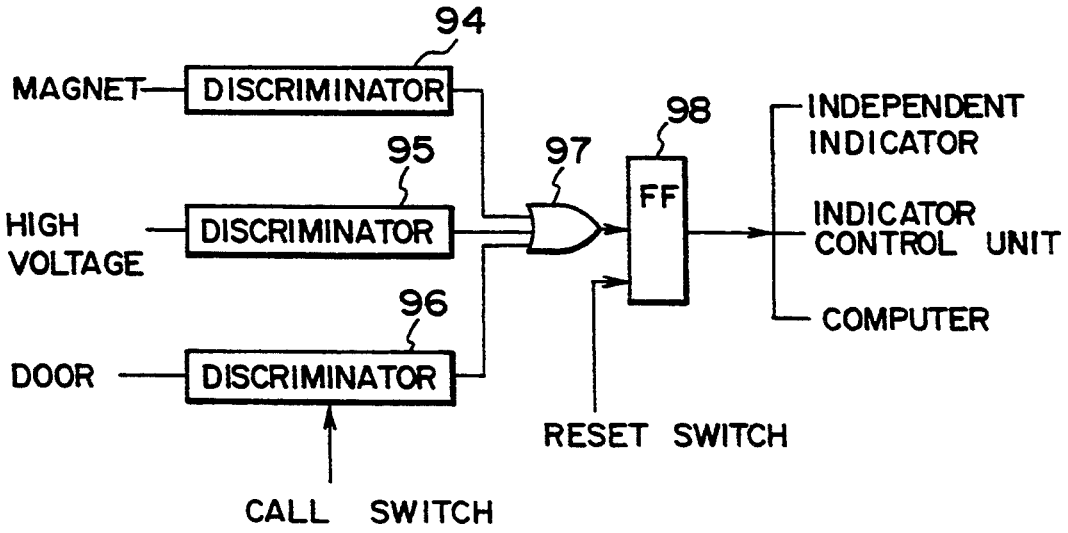
FIG. 8 illustrates an unfairness discriminating function in the embodiment.

For the foulplay detecting function, the discriminator 90, as shown in FIG. 8, also includes a discriminating circuit 94 for discriminating the approach of a magnet, a discriminating circuit 95 for discriminating the existence of a high voltage, a discriminating circuit 96 for discriminating the opening of a door, an OR circuit 97 for taking the logical sum of these discrimination results, and a flip-flop 98 for self-maintaining the output of the OR circuit 97.

In the case of the call switch, since a cause can be differentiated from other causes, a discriminating circuit for this purpose is not needed. In such an event, a discriminating circuit should be effective only while the switch is depressed (not shown). The output of the call switch is sent to the indicator control unit 100.

Figure 9:
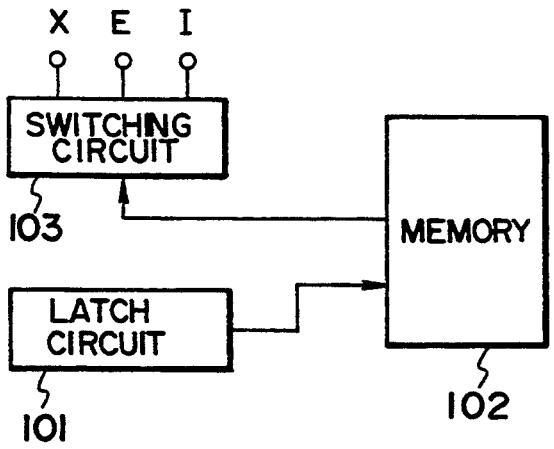
FIG. 9 is a block diagram showing an indicator control unit to be used in the embodiment.

The indicator control unit 100, as shown in FIG. 9, includes a latch circuit 101 for latching the discrimination result of the discriminator 90, a memory 102 for storing the indicator lighting mode data corresponding to the discriminating result latched by the latch circuit 101, and a switching circuit 103 for generating activating waveforms of X, E and I lines, which constitute signal lines 8 corresponding to the respective indicating elements, based on the indicator lighting mode data that was read from the memory 102.

The latch circuit 101 performs a latching action in a constant cycle so as to meet the change of status of the game machine. For instance, since the call switch is not self-maintained, calling information will not be latched at the next time if the player releases the call switch. If sensor inputs concerning, for example, other prizes and foulplay are reset, information about them will not be latched at the next time. Whereas if a status continues, information indicating the status will be latched, and the indicating mode will also continue.

The signal from the discriminator 90 may be preset so as to be inputted in bits to the latch circuit 101. From a bit pattern of the latch circuit 101, it is possible to discern the content of an event. This bit pattern is sent to the memory 102.

The memory 102 previously stores indicator light mode data concerning the activating waveform corresponding to the bit pattern. In this case, the memory 102 has a table including bit patterns and addresses in which activating waveform information corresponding to the bit patterns are stored, from which table necessary activating waveform information can be obtained. The memory 102 may use bit patterns themselves as addresses whose corresponding activating waveform information are stored.

The X, E and I lines are associated with the corresponding indicating elements of the indicators 2, 3. For example, the X line corresponds to the indicating elements **2*b*, 3*b*; the E line, to the indicating elements 2*a*, 3*a*; and the I line, to the indicating elements 2*c*, 3*c*. These relationships may be altered. The individual indicating element may emit light of a predetermined color. For example, the indicating elements 2*b*, 3*b*, 2*c*, 3*c* may emit red light, and the indicating elements 2*a*, 3*a*** may emit yellow light.

Figure 10:
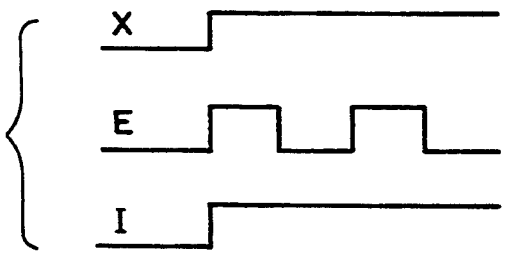
FIG. 10 is a waveform diagram illustrating how the individual indicating elements act.

The activating waveforms to be generated by the switching circuit 103 are predetermined in conformity with the content of an event. For example, the waveforms may be determined in such a manner that the X line will be turned on in the case of a call, that the X, E and I lines will be flashed in order in the case of a prize, and that the E line will be flashed in the case of foulplay. Further, additional waveforms may be predetermined for combined events. These examples are shown in FIGS. 10, 11 and 12. For example, the activating waveforms of FIG. 10 will activate the X and I lines to continuously light, and the E line to flash, thereby indicating a call and a prize. The activating waveforms of FIG. 11 will activate the X and I lines to continuously light and the E line to flash at a frequency higher than the case of FIG. 10, thereby indicating a call and foulplay. The activating waveforms of FIG. 12 will activate the X and I lines to flash alternately and the E line to flash at a frequency higher than the case of FIG. 10, thereby indicating a prize and foulplay.

These operating modes may be determined in alternative ways. For example, it is possible to determine the operating modes of the individual indicating elements of the indicators corresponding to various kinds of events, as shown in FIGS. 13 and 14.

In this embodiment, when the alarm system is operated, the discriminator 90 will monitor whether or not signals are inputted from the group of inputting devices 70.

Assuming that an accident such as the jamming of tokens has occurred in a game machine, the player presses the switch 71 to give notice to the arcade attendant. Upon depression of the switch 71, the discriminator 90, which monitors the inputting devices 70, discriminates the call and sends its output to the independent indicator 80 for lighting, thereby indicating the call. This output is also sent to the indicator control unit 100 and a non-illustrated managing computer.

When a signal is inputted from the sensor 72, the prize discriminating circuit 92 discriminates whether or not the input signal represents a prize. When the prize is discriminated, the result of discrimination is sent to the independent indicator 80, thus indicating the prize. This output is also sent to the indicator control unit 100, the non-illustrated managing computer and a prize frequency indicator.

Each discriminating circuit 94, 95, 96 discriminates the presence or absence of an input signal from the sensor 73. This result is sent via the OR circuit 97 to the flip-flop 98. The output of the flip-flop 98 is sent to the independent indicator 80 so that the latter is turned on. This output is also sent to the indicator control unit 100 and the non-illustrated managing computer.

The input from the switch 71 and the inputs from the sensors 72, 73 are independent events that are inputted individually. So a plurality of inputs may be active simultaneously. Consequently the discriminator 90 discriminates such independent inputs individually and sends the respective results to the indicator control unit 100, etc.

In the indicator control unit 100, upon receipt of signals from the discriminator 90, the latch circuit 101 latches these signals. This bit pattern is sent to the memory 102. Then the activating waveform information corresponding to the bit pattern will be outputted. The switching circuit 103 generates the above-mentioned activating waveforms of the X, E and I lines, based on the activating waveform information.

The activating waveforms of the X, E and I lines are sent to the indicator activators 20, 30 via the signal lines 8. The indicator activators 20, 30 activate the corresponding indicating elements *2a*, *2b*, *2c*, *3a*, *3b*, *3c*, depending on the activating waveforms, by switching, for example.

The indicators 2, 3 are thereby activated in predetermined indicating modes. By monitoring the indicators 2, 3 of one or more game machine islands, the arcade attendant in charge can find the occurrence of an event in any of the islands. When monitoring from a position near one end portion of any island, the arcade attendant only needs to watch the indicator 2 at the one end of the island. Whereas in monitoring from a path between adjacent game machine islands, the attendant only needs to watch the indicator 3. The arcade attendant can therefore find an abnormal condition easily, irrespective of his/her position.

Further, since an event can be indicated in a predetermined indicating mode, it is possible to know the content of the event previously. Therefore the arcade attendant can investigate a cause for the event easily and hence can make a quick repair, thus guaranteeing improved service to players.

After having resolved the event, the arcade attendant depresses a non-illustrated reset switch for restarting the alarm system.

In this embodiment, one indicator is located at the center of a game machine row in the island. Alternatively two or more indicators may be arranged at two or more places in a game machine row in the island.

Further in the embodiment, the indicator 3 is located upwardly of the counter B. Alternatively the indicator 3 may be located at any other position.

According to this invention, since it is possible to have at least one indicator in the attendant's field of vision, irrespective of his/her position, the attendant can descern the occurrence of an event of the game machine island easily and without delay.

Furthermore, since the indicator can be activated in an indicating mode corresponding to the content of an event, it is possible to learn the content of an event simultaneously with finding the indication of the event on the indicator.

What is claimed is:

1. An alarm system for warning of the occurrence of events at a certain island in an amusement arcade where a plurality of islands of game machines are installed, each island having one or two rows of game machines, said alarm system comprising:

(a) a plurality of indicators for each island, said plurality of indicators being disposed at both side ends of each of a plurality of islands of game machines; and (b) a plurality of event detectors for each of said gaming machine, each for detecting the occurrence of one of the events to activate the corresponding one of said plurality of indicators so that an arcade attendant is notified of one of said events upon detection of one of said events.

2. An alarm system according to claim 1, wherein each of said event detectors includes one or more input devices for receiving a signal indicating the occurrence of the events.

3. An alarm system according to claim 2, wherein said input devices of each of said plurality of event detectors are coupled to each of said game machines.

4. An alarm system according to claim 3, wherein each of said input devices comprises a manual switch to be operated by a player.

5. An alarm system according to claim 4, wherein each of said input devices comprises one or more sensors for detecting the condition of each game machine.

6. An alarm system according to claim 5, wherein each of said plurality of indicators includes a plurality of said indicating devices.

7. An alarm system according to claim 6, wherein each of said indicating devices is a lamp.

8. An alarm system according to claim 7, wherein each said event detectors includes a discriminator for discriminating the content of the event for the signal indicating the occurrence of the event and taken into said system, and an indicator control unit for determining an indicating mode of said lamp based on the result of discriminatinq said event detectors.

9. An alarm system according to claim 8, wherein said indicator control unit has a function of determining the indicating mode of said lamp out of a plurality of indicating modes, which includes a continually lighting mode, a flash lighting mode and a non-lighting mode, respectively, corresponding to a plurality of predetermined events to be indicated.

10. An alarm system according to claim 9, wherein said indicating modes to be determined by said indicator control unit further include an indicating mode corresponding to the simultaneous occurrence of a plurality of kinds of said events.

11. An alarm system according to claim 1, wherein each island includes a token counter disposed at a center of each of said rows of game machines.

12. An alarm system according to claim 11, wherein said indicator at the center of each of said rows of game machines is located on and at an upper portion of said token counter.

13. An alarm system according to claim 12, wherein each island also has a plurality of token dispensers having token counters, said plurality of token dispensers being arranged between the game machines in an alternating arrangement within each of said rows of game machines.

14. An alarm system according to claim 13, wherein each of said plurality of event detectors includes an input unit corresponding to each of said token dispensers.

15. An alarm system according to claim 1, wherein said plurality of indicators is further disposed at a center of each of said rows of game machines of the plurality of islands.

16. An alarm system according to claim 12, wherein each island further includes a plurality of token dispensers, said plurality of token dispensers forming pairs with the gaming machines arranged adjacently thereto respectively, said pairs being arranged within each of said rows of game machines.

* * * * *